United States Patent [19]
Hanyu et al.
[11] 4,290,377
[45] Sep. 22, 1981

[54] SEWING MACHINE

[75] Inventors: Susumu Hanyu; Kenji Kato, both of Hachioji, Japan

[73] Assignee: Janome Sewing Machine Co., Ltd., Tokyo, Japan

[21] Appl. No.: 92,946

[22] Filed: Nov. 9, 1979

[51] Int. Cl.³ ..... D05B 3/02
[52] U.S. Cl. ..... 112/158 E
[58] Field of Search ..... 112/158 E, 158 R, 158 A, 112/158 D

[56] References Cited

U.S. PATENT DOCUMENTS

| | | | |
|---|---|---|---|
| 3,977,338 | 8/1976 | Wurst et al. | 112/158 EX |
| 3,985,087 | 10/1976 | Herr et al. | 112/158 R |
| 4,048,932 | 9/1977 | Odermann et al. | 112/158 E |
| 4,145,982 | 3/1979 | Kume et al. | 112/158 E |

FOREIGN PATENT DOCUMENTS

| | | | |
|---|---|---|---|
| 2903030 | 8/1979 | Fed. Rep. of Germany | 112/158 E |

*Primary Examiner*—Peter P. Nerbun
*Attorney, Agent, or Firm*—Michael J. Striker

[57] ABSTRACT

A sewing machine having a rotary shaft, a needle bar, a fabric feeding device and an electronic control device for controlling the needle position is provided with a manually operated arrangement to selectively render the electronic control device operative or inoperative when desired to obtain the straight stitching or zigzag stitching, respectively. This arrangement includes a plurality of cams operatively connected to a dial positioned on the housing of the sewing machine and a switch cooperating with said cams and adapted to actuate the electronic control device.

4 Claims, 2 Drawing Figures

SEWING MACHINE

BACKGROUND OF THE INVENTION

The present invention relates to a sewing machine which may be used as a manually operated mechanical sewing machine for the straight stitching operation, and which may be used as an electronic sewing machine for automatically stitching various patterns by way of electronic circuits including a state electronic memory storing the pattern data.

So-called electronic sewing machine, which is provided with the static memory and electronic devices for determining the needle positions and the feeding amounts and directions per stitch in response to a signal from said static memory, has its own merits in comparison with the conventional mechanical sewing machines, that in the electronic sewing machine, so many pattern cams and other complex parts for pattern selection of the mechanical sewing machine may be replaced by small sized and compact electronic devices, and that the electronic sewing machine may attain to considerably difficult and complicated functions of high degree more easily and more neatly. On the other hand, it may be said that more than 90% of the stitching operation is directed to the straight stitching, and furthermore the merits or effects of the electronic sewing machine are hardly utilized for the straight stitching. If the simple straight stitch is to be controlled by the electronic devices, said electronic device and the relative parts must be electrically conductive in the meantime, and the electric power is considerably consumed with the increase of temperature of the parts. Besides the noise is liable to be higher than for the mechanical sewing machine. Further, since the composing elements and connections of the electric circuits are very complicated, the straight stitching operation becomes impossible if even a minor part is out of order. In view of these circumstances, the invention provides a sewing machine including the electronic devices, in which the easy straight stitching operation is performed independently from the electronic devices, but dependently on the pure mechanism.

SUMMARY OF THE INVENTION

It is therefore a primary object of the invention to provide a sewing machine which may be switched to a mechanically or electronically functioning sewing machine.

It is another object of the invention to save the electric power and lower noise during straight stitching operation.

The other features and advantages of the invention will be apparent from the following description of the invention in reference to preferred embodiments as shown in the attached drawings.

DETAILED DESCRIPTION OF THE INVENTION

Figure 1:
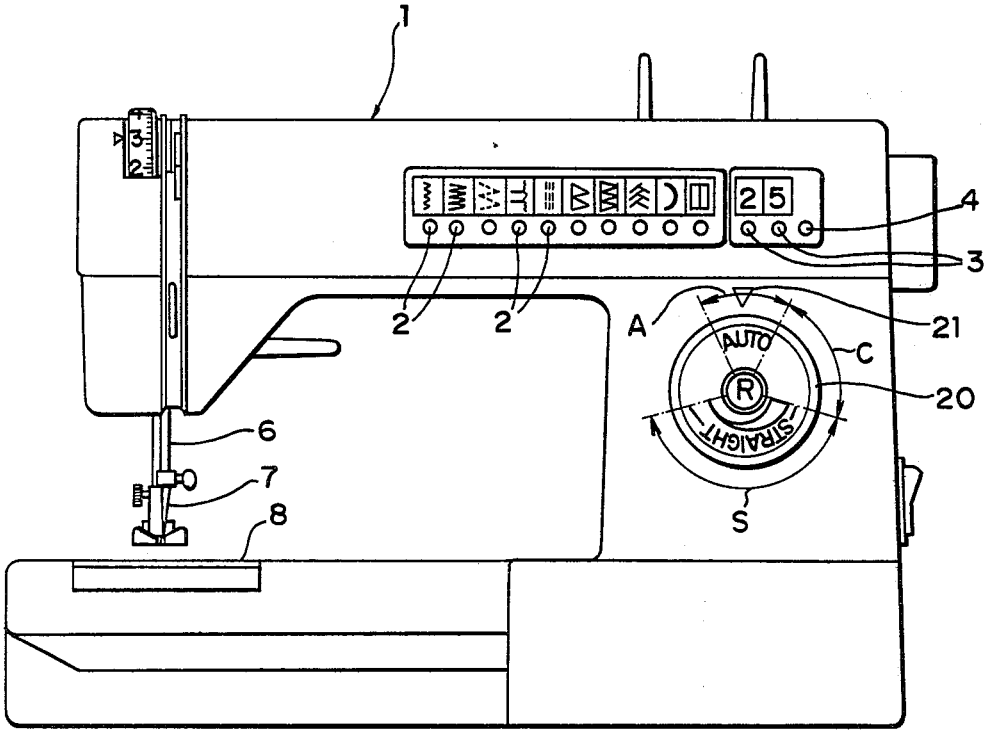
FIG. 1 shows an outer appearance of a sewing machine according to the invention.
Figure 2:
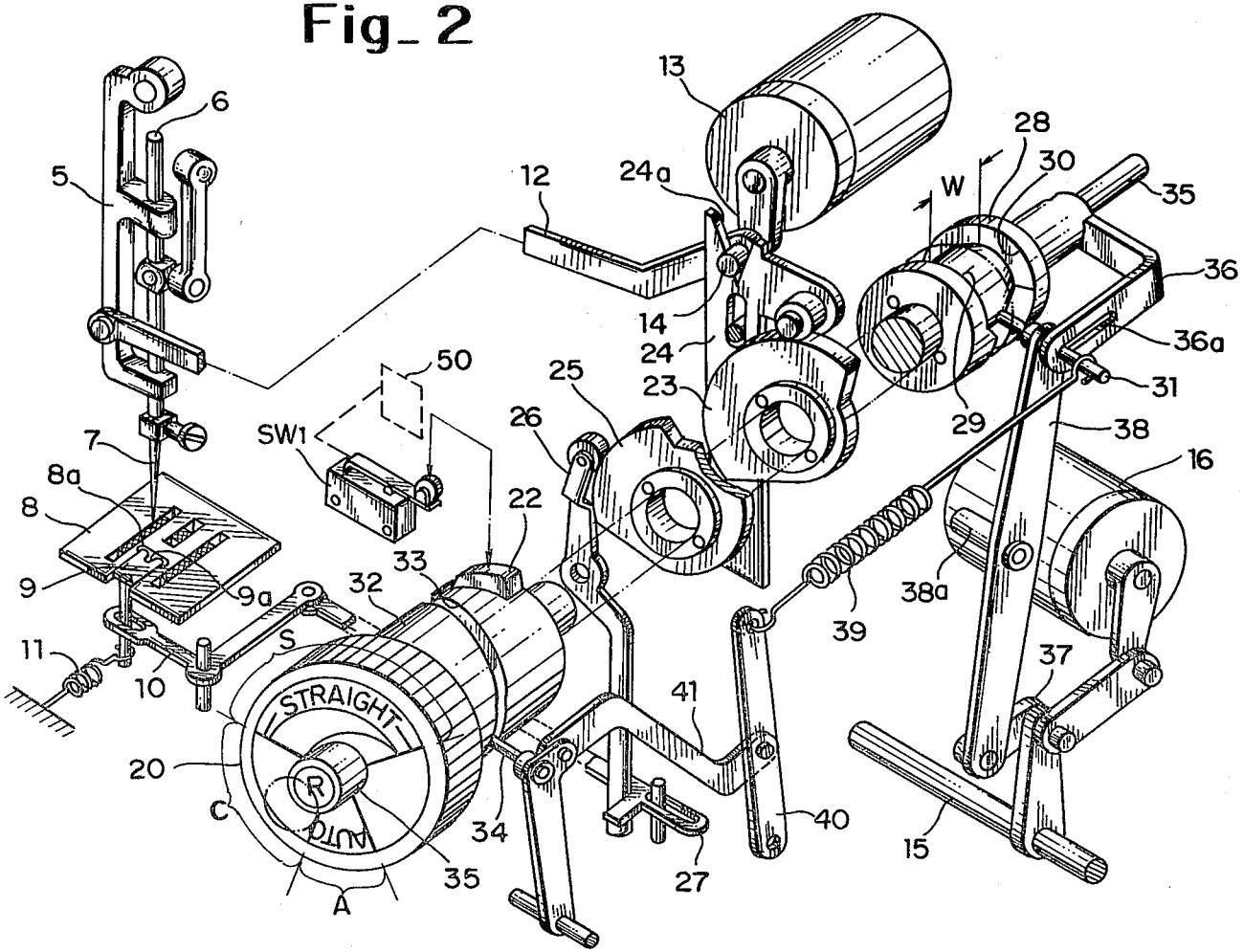
FIG. 2 is an exploded perspective view of a mechanism of the sewing machine.

The present invention will be explained in reference to the attached drawings. A numeral 1 denotes the sewing machine in general, and numeral 2 designate switch buttons each arranged in correspondence to patterns to be frequently used. Reference numeral 3 indicates switch buttons for calling up the patterns by the respective pattern numbers (two figures in the present embodiment) each given to the stitch patterns which are not so frequently used. These patterns, which are not so frequently used, and indicated in windows (2, 5 as shown in FIG. 1) by two figures are called up by operating the switch buttons 3. A numeral 4 indicates a switch button which is operated to clear said calling up and to prepare the patterns which are not so frequently used. Referring to FIG. 2, numeral 5 designates a needle bar support swingably mounted on the sewing machine, 6 shows a needle bar mounted on the support 5 for vertical reciprocation, 7 indicates a needle, 8 shows a needle plate formed with a needle hole 8*a* for zigzag stitching. Numeral 9 indicates a needle plate element formed with a needle hole 9*a* for the straight stitch and so arranged as to move in the directions toward and away from the zigzag stitching needle hole 8*a*. Numeral 10 denotes a crank lever which is turned in the clockwise direction against the action of a spring 11 to move the needle plate element 8 toward the zigzag stitching needle hole 8*a*, thereby to provide the straight stitching needle hole 9*a*. The reference numeral 12 is a rod for laterally swinging the needle bar support 5. Number 13 denotes a pulse motor for controlling swinging amplitude of the needle 7. Numeral 14 indicates a crank pin which is operatively connected to the pulse motor 13 and passing through one end of the rod 12. Numeral 15 designates a shaft for controlling angular position of a feed adjuster (not shown) to regulate the fabric feed, and 16 indicates a pulse motor operatively connected to the shaft 15 to control the fabric feed. Regarding the above mentioned pulse motors 13 and 16, detailed reference is omitted. In this embodiment, the sewing machine may be set to operate as an electronic sewing machine by operating a switch SW1 which make an electronic circuit not shown in detail but schematically illustrated and denoted as 50 operative. In such a condition, if a pattern is selected by operating one of the switches 2, 2, . . . or 3, the sewing machine is set to stitch the selected pattern in accordance with the pattern signals issued from the memory in synchronism with rotation of the sewing machine to thereby automatically form the desired pattern.

Numeral 20 indicates a dial which is rotatably arranged on the machine casing. The dial is provided indications on the front face of the machine such as the automatic pattern range (A) and the straight stitching range (S). In FIG. 1, the dial 20 is manually rotated through the operation switching range (C) with respect to the reference point 21 on the machine casing to select the automatic pattern stitching range (A) or the straight stitching range (S). The dial 20 is composed of cams coaxially secured. In FIG. 2, numeral 22 indicates a switching cam which is so arranged as to close said switch SW1 (positioned in a suitable place) when the range (A) of the dial 20 is selected. Numeral 23 is a cam which designates during manual rotation of the dial 20 for selecting the straight stitching range (S) to upwardly shift a notched plate 24 as shown in FIG. 2 until the notch 24*a* engages a crank pin 14 so as to fix the needle bar support 5 in the straight stitching position. Numeral 25 denotes a cam for changing the needle dropping hole of the needle plate 8. The cam 25 is also rotated together with the cam 23 to turn a needle switching lever 26 in the counterclockwise direction to thereby turn the crank lever 10 in the clockwise direction via a connecting rod 27 against the action of the spring 11. Thus the needle plate element 9 is moved toward the zigzag stitching needle hole 8*a* to replace the same with the straight stitching needle hole 9*a*. Numeral 28 indicated a feed adjusting cam which is formed with a groove composed of side cams 29, 30. The width (W) of the groove is narrower in the straight stitching range (S) as the dial 20 is rotated in the counterclockwise direction relative to the reference point 21. The reference numeral 32 denotes a cam adapted to change a spring pressure for the feed adjuster (not shown). The reference numeral 35 is a shaft passing through the dial 20 and the cams 22, 23, 25, 28, 32 and is axially shiftable for the forward and backward stitches.

A numeral 31 indicates a feed control pin which is provided at one end of a feed control lever 38 which is pivoted at the intermediate part 38*a* thereof to the machine casing and which is at the other end operatively connected to a feed adjuster control shaft 15 via a link 37. The feed control pin 31 has one end placed in the groove of the opposite side cams 29, 30 for controlling the forward and backward stitches respectively. A numeral 34 shows a pin engaging a cam groove 33 of the cam 32, and is positioned remote from the dial 20 when the stitching range (A) is brought to the reference point 21, and is nearer to the dial 20 when the stitching range (S) is brought to the reference point 21. A numeral 39 indicates a biasing spring for feed controlling and is at one end connected to the pin 31 and is connected at the other end to a link 40 as shown. The spring 39 is expanded via links 40, 41 when an engaging pin 34 located in the groove 33 is positioned nearer to the dial 20 as shown where the straight stitching range (S) is selected, so that it presses the pin 31 against the side cam 29 for controlling the forward stitching. On the other hand, when the automatic pattern stitching range (A) is selected, the pin 34 is positioned remote from the dial 20. As a result, the spring 39 becomes ineffective and gives no influence to the pin 31. The reference numeral 36 designates a plate element formed with a slot 36*a* at the free end part thereof. The plate element 36 is at one end connected to the shaft 35 and engaging the pin 31 with the slot 36*a*. Therefore, if the shaft 35 is axially pushed, the pin 31 is pressed against the side cam 30 for controlling the backward stitching.

With the above mentioned structure of the sewing machine, if the dial 20 is rotated to bring the automatic pattern stitching range (A) to the reference point 21, the needle plate element 9 is retreated from the elongated zigzag stitching needle dropping hole 8*a* of the needle plate 8 by the spring 11 due to the configuration of the control cam 25, and thus the zigzag stitching needle dropping hole 8*a* is provided. Simultaneously, the cam 23 allows the notched plate 24 to downwardly shift away from the pin 14, and thus the needle bar support 5 becomes free to be laterally swingable by the pulsemotor 13 via transmission rod 12. Simultaneously the cam 28 allows the pin 31 to be controlled by the pulse motor 16 via lever 38 for controlling the feeding device (not shown). Simultaneously the cam 22 closes the switch (SW1) to make the electronic control circuit (not shown) operative. As the result, the sewing machine is set as an electronic sewing machine, and a desired stitch pattern can be selected by operating one of the pattern selecting switch buttons 2 and 3 to automatically stitch the selected stitch pattern.

On the other hand, if the dial 20 is rotated to bring the straight range (S) to the reference point 21, the cam 22 opens the switch (SW1) to make inoperative the electronic control circuit, and the cam 23 shifts the notched plate 24 to the position engaging the pin for fixing the needle bar support 5 for functioning of the latter in the straight stitching. Simultaneously the cam 25 moves the needle plate element 9 toward the elongated needle dropping hole against the spring 11 by way of a follower lever 26, transmission rod 27 and the crank lever 10, to thereby provide the reduced needle dropping hole 9*a* l for the straight stitching. Simultaneously the cam groove 33 of cam 32 displaces the pin 34 toward the dial 20 to give the sufficient tension to the spring 39, to thereby press the pin 31 against the side cam 29 for controlling the forward feeding. As to the fabric feeding of the invention, the feeding amount is maximum if the first end of the straight stitching range (S) comes to be in alignment with the reference point 21 as the dial 20 is rotated in the counterclockwise direction. As the dial 20 is rotated in the same direction relative to the reference point 21, the feeding amount becomes smaller, and becomes minimum if the last end of the range (S) comes in alignment with the reference point 21. When any part of the stitching range (S) is in alignment with the reference point 21, the backward feeding amount, which is the same as the forward feeding amount, can be obtained by pushing the shaft 35, because the pin 31 is pressed against the opposite side cam 30. Namely the opposite side cams 29, 30 are so structured as to provide the same feeding amount in the different feeding directions. Thus the sewing machine is set to operate as a manually operated straight stitching sewing machine.

We claim:

1. In a sewing machine having a rotary drive shaft, a needle bar with a needle mounted for vertical and lateral reciprocation to penetrate a fabric to be sewn, a feeding device including a feed adjuster to control the fabric feeding amount and the direction of fabric feeding, an electronic control device electrically operated to generate a stitch control signal per rotation of the rotary shaft of the sewing machine for controlling the needle position and the fabric feeding position, and electric means activated by the stitch control signal for actually controlling the needle position and the fabric feeding position to automatically produce various stitch patterns, the combination comprising means manually operated to a first range to render the electronic control device operative and to a second range to render the electronic control device inoperative; and switch means adapted to be closed for rendering the electronic control device operative or opened for rendering the electronic control device inoperative, said manually operated means including first cam means to open said switch means, second cam means operatively connected to the feed adjuster and being operative for adjusting the latter for feeding the fabric in a forward direction, the third cam means operatively connected to the needle bar and being operative for displacing the needle to a predetermined position and maintaining the needle in said predetermined position.

2. The sewing machine as defined in claim 1, further comprising a needle plate formed with an elongated needle dropping hole for zigzag stitching, a needle plate element constituting a part of said needle plate and formed with a reduced needle dropping hole for straight stitching, said needle plate element being slidably movable toward and away from said elongated needle dropping hole, said manually operated means including fourth cam means operatively connected to said needle plate element and adapted to slidably move said needle plate element towards said elongated needle dropping hole to change the latter to said reduced needle dropping hole for straight stitching.

3. The sewing machine as defined in claim 1, wherein said electric means comprises a first pulse motor for controlling the needle position and a second pulse motor for controlling the fabric feeding position.

4. The sewing machine as defined in claim 1, further comprising a transmission rod connected between the needle bar and said first pulse motor, said manually operated means further including a notched plate operatively connected to said third cam means and being displaced by said third cam means to fixedly hold said transmission rod in a predetermined position.

* * * * *